US006872018B2

(12) United States Patent
Jung

(10) Patent No.: US 6,872,018 B2
(45) Date of Patent: Mar. 29, 2005

(54) METHOD AND APPARATUS FOR CONTROLLING PAPER TRANSPORT BASED UPON AMBIENT PRINTER TEMPERATURE

(75) Inventor: Jong-sung Jung, Gyeonggi-do (KR)

(73) Assignee: Samsung Electronics Co., LTD, Suwon-Si (KR)

( * ) Notice: Subject to any disclaimer, the term of this patent is extended or adjusted under 35 U.S.C. 154(b) by 0 days.

(21) Appl. No.: 10/676,076

(22) Filed: Oct. 2, 2003

(65) Prior Publication Data

US 2004/0101344 A1 May 27, 2004

(30) Foreign Application Priority Data

Nov. 25, 2002 (KR) ..... 10-2002-0073479

(51) Int. Cl.[7] ..... B41J 29/393

(52) U.S. Cl. ..... 400/578; 400/624; 400/636; 271/3.15

(58) Field of Search ..... 400/582, 578, 400/624, 625, 629, 636, 637; 271/3.15, 3.17, 4.02, 4.03, 10.02, 10.03; 347/5, 16, 104, 105

(56) References Cited

U.S. PATENT DOCUMENTS 5,927,703 A * 7/1999 Endo ..... 271/10.03
6,364,452 B1 * 4/2002 Noyes et al. ..... 347/43

FOREIGN PATENT DOCUMENTS

| | | | |
|---|---|---|---|
| JP | 62-185648 | * | 8/1987 |
| JP | 2-171262 | * | 7/1990 |
| KR | 1998-061433 | | 11/1998 |

* cited by examiner

*Primary Examiner*—Leslie J. Evanisko
(74) *Attorney, Agent, or Firm*—Staas & Halsey LLP

(57) ABSTRACT

A printing apparatus having a paper feeding unit with a feed roller that moves paper supplied from a paper tray to a printing unit, and an exit roller that releases the paper on which the printing operation is performed by the printing unit, the printing apparatus including a temperature sensor sensing an ambient temperature of the printing apparatus; and a driving controller controlling the driving of the feed roller and the exit roller according to the ambient temperature sensed by the temperature sensor.

15 Claims, 5 Drawing Sheets

METHOD AND APPARATUS FOR CONTROLLING PAPER TRANSPORT BASED UPON AMBIENT PRINTER TEMPERATURE

CROSS-REFERENCE TO RELATED APPLICATIONS

This application claims the benefit of Korean Application No. 2002-73479, filed Nov. 25, 2002, in the Korean Intellectual Property Office, the disclosure of which is incorporated herein by reference.

BACKGROUND OF THE INVENTION

1. Field of the Invention

The present invention relates to a printing apparatus, and, more particularly, to a printing apparatus in which a variation in a line feed length and a change in the physical properties of paper caused by a change in the temperature of the printing apparatus are compensated for, thereby improving the quality of printing and enabling paper to be easily picked up from a paper tray.

2. Description of the Related Art

A printing apparatus is an apparatus that prints an image or text on the surface of paper. FIG. 1 schematically illustrates the structure of a conventional printing apparatus. Referring to FIG. 1, the printing apparatus includes a paper feeding unit, a paper transferring unit, a printing unit, and a paper releasing unit. The paper feeding unit feeds paper P into the printing apparatus, and includes a paper tray 10 on which the paper P is placed and a pickup roller 12 that picks up the paper P placed on the paper tray 10. The paper transferring unit transfers the paper P supplied from the feeding unit to the printing unit, and includes a feed roller 14 that precisely transfers the paper P to the printing unit and a pressure roller 16 that applies a friction force to the feed roller 14 to aid in transferring the paper P. The printing unit prints an image or text on the paper P transmitted by the paper transferring unit, and includes a print head 18 that discharges ink droplets onto the paper P through a nozzle 20, and a carriage 22 to which the print head 18 is attached. The carriage 22 includes a temperature sensor 24 that controls the temperature of the nozzle 20 of the print head 18. The paper releasing unit releases the paper P on which an image or text has been printed by the printing unit and includes an exit roller 26, and an exit wheel 28.

In a conventional printing apparatus having the above structure, a sheet of the paper P stacked on the paper tray 10 is picked up by the pickup roller 12 and positioned between the feed roller 14 and the pressure roller 16. Then, the paper P is gradually moved by a line feed length according to a predetermined rotation angle of the feed roller 14. Precision in the line feed length is expressed as a resolution that is used to verify the quality of printing. In general, the printing apparatus is manufactured to have a resolution in a line feed length of 600 dots per inch (dpi). If the resolution is 600 dpi, the distance between adjacent dots is about 42 $\mu$m.

To precisely transfer the paper P, the dimensions of the outer diameter of the feed roller 14 must be precisely controlled. Typically, the outer diameter of the feed roller 14 is determined based on an assumption that the printing apparatus operates at room temperature, for example, 22° C., and the line feed length is set based on the determined outer diameter of the feed roller 14. However, the ambient temperature in which the printing apparatus operates may change within a wide range, approximately from 5° C., to 40° C. A change in the ambient temperature results in a change in the outer diameter of the feed roller 14, that is, the feed roller 14 may expand or contract, and as a result, the line feed length also changes. Therefore, when using the conventional printing apparatus, a change in the ambient temperature may degrade the quality of printing. For example, an unexpected white or black line could appear on the paper P.

The distance between the paper P and the nozzle 20 of the print head 18 depends on a ratio of the linear velocity of the outer surface of the feed roller 14 to that of the outer surface of the exit roller 26. The quality of printing is greatly affected by the distance between the paper P and the nozzle 20. In general, the feed roller 14 and the exit roller 26 are manufactured using different materials and the dimensions of their outer diameters differ from one another. A change in the ambient temperature results in a change in the ratio of the linear velocity of the outer surface of the feed roller 14 to that of the outer surface of the exit roller 26. A change in this ratio deteriorates the quality of printing.

The amount of moisture contained in the paper P decreases at a low temperature, and a reduction in the amount of moisture increases the stiffness of the paper P. In this case, the intensity of a force required to pick up the paper P from the paper tray 10 must be increased. A paper pickup system of a conventional printing apparatus is set to appropriately operate at room temperature, and, therefore, it would be difficult to pick up paper from a paper tray when operating the paper pickup system at low temperatures.

SUMMARY OF THE INVENTION

It is an aspect of the present invention to provide a printing apparatus in which variations in line feed length and in the physical properties of paper caused by a change in the ambient temperature are compensated for, thereby improving the quality of printing and enabling paper to be easily picked up from a paper tray.

Additional aspects and/or advantages of the invention will be set forth in part in the description that follows and, in part, will be obvious from the description, or may be learned by practice of the invention.

To achieve the above and/or other aspects of the present invention, there is provided a printing apparatus having a paper feeding unit with a feed roller that moves paper supplied from a paper tray to a printing unit, and an exit roller that releases the paper on which the printing operation is performed by the printing unit, the printing apparatus including a temperature sensor sensing an ambient temperature of the printing apparatus; and a driving controller controlling the driving of the feed roller and the exit roller according to the ambient temperature sensed by the temperature sensor.

The driving controller compensates for variations in line feed lengths of the feed roller and the exit roller according to the ambient temperature.

A pickup roller picks up paper stacked on the paper tray and supplies the paper to the feed roller, and the driving controller controls the driving of the pickup roller according to the ambient temperature sensed by the temperature sensor. The driving controller adjusts the rotation speed and output torque of a driving motor, which drives the pickup roller, according to the ambient temperature sensed by the temperature sensor to compensate for a change in the physical properties of the paper stacked on the paper tray due to a change in the ambient temperature.

To achieve the above and/or other aspects according to the present invention, there is provided a method of controlling a feed roller and an exit roller of a printing apparatus according to an ambient temperature of the printing apparatus, the printing apparatus having a driving motor connected to the feed roller and the exit roller, the method including determining line feed lengths of the feed roller corresponding respectively to ambient temperatures in a predetermined range of ambient temperatures; sensing an actual ambient temperature of the printing apparatus; determining a line feed length of the feed roller corresponding to the sensed ambient temperature, and determining a line feed length of the exit roller corresponding to the sensed ambient temperature; and driving, by the driving motor, the feed roller according to the determined line feed length of the feed roller and driving the exit roller according to the determined line feed length of the exit roller, to compensate for a variation in the line feed length of the feed roller and for a variation in the line feed length of the exit roller due to a change in the ambient temperature of the printing apparatus.

To achieve the above and/or other aspects according to the present invention, there is provided a method of controlling a pickup roller of a printing apparatus according to an ambient temperature of the printing apparatus, the printing apparatus having a paper tray and a driving motor connected to the pickup roller to pick up paper from the paper tray, the method including determining rotation speeds and torques of the driving motor corresponding respectively to ambient temperatures in a predetermined range of ambient temperatures; sensing an actual ambient temperature of the printing apparatus; determining a rotation speed and a torque of the driving motor corresponding to the sensed ambient temperature; and driving the driving motor connected to the pickup roller according to the determined rotation speed and torque, enabling the paper to be easily picked up from the paper tray.

These, together with other aspects and/or advantages that will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and/or other aspects and advantages of the invention will become apparent and more readily appreciated from the following description of the preferred embodiments, taken in conjunction with the accompanying drawings, of which.

DETAILED DESCRIPTION OF THE INVENTION

Figure 1:
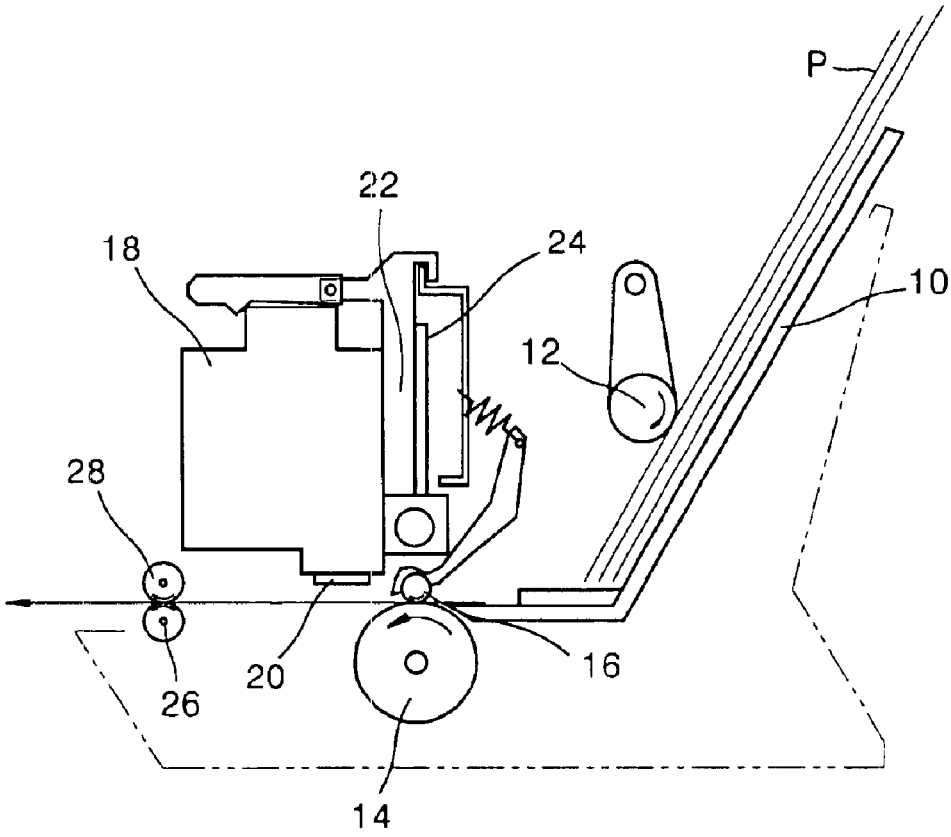
FIG. 1 (PRIOR ART)
FIG. 1 schematically illustrates the structure of a conventional printing apparatus.

Hereinafter, an embodiment of the present invention will be described in detail with reference to the attached drawings, wherein the like reference numerals refer to the like elements throughout. The present invention may, however, be embodied in many different forms and should not be construed as being limited to the embodiment set forth herein; rather, this embodiment is provided so that the present disclosure will be thorough and complete, and will fully convey the concept of the invention to those skilled in the art.

Figure 2:
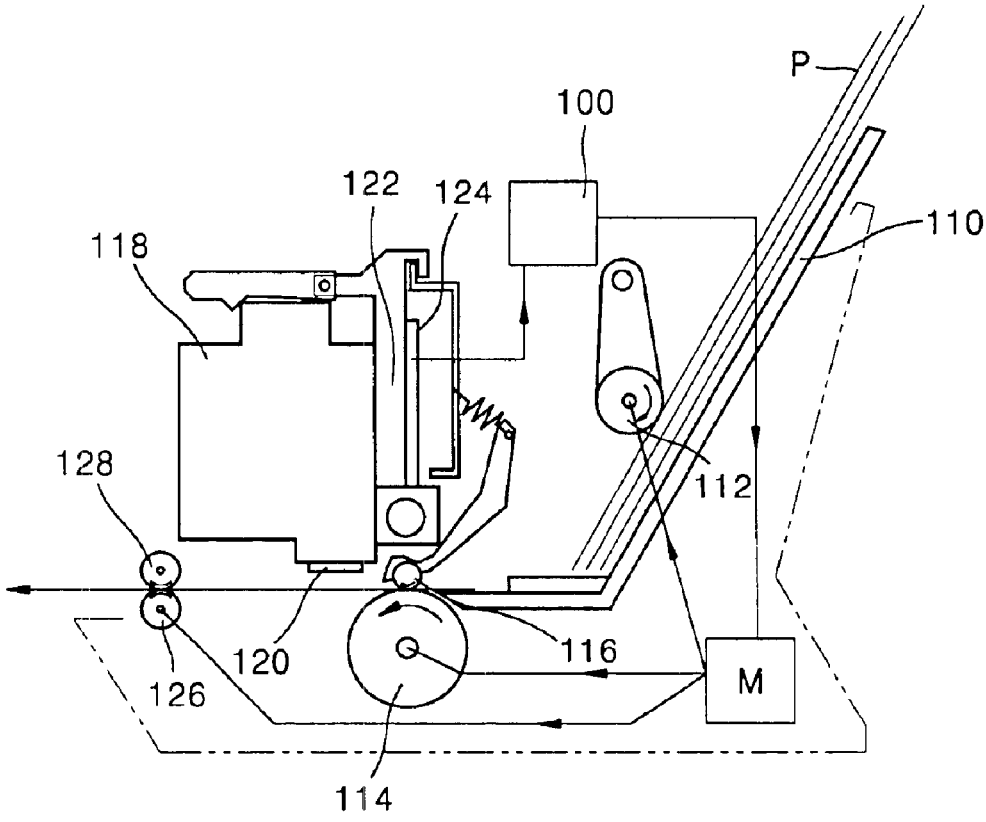
FIG. 2 schematically illustrates the structure of a printing apparatus according to an embodiment of the present invention.

FIG. 2 schematically illustrates the structure of a printing apparatus according to an embodiment of the present invention. Referring to FIG. 2, the printing apparatus includes a paper feeding unit, a paper transferring unit, a printing unit, and a paper releasing unit. The paper feeding unit includes a paper tray 110 on which paper P is stacked, and a pickup roller 112 that picks up a sheet of the paper P from the paper tray 110. The paper transferring unit includes a feed roller 114 that precisely transfers the paper P supplied from the paper feeding unit to the printing unit, and a pressure roller 116 that applies a friction force to the feed roller 114 to aid in the transference of the paper P. The printing unit includes a print head 118 that discharges ink droplets through a nozzle 120 onto the paper P, and a carriage 122 to which the print head 118 is attached that reciprocates in the horizontal direction. The carriage 122 includes a temperature sensor 124 that adjusts the temperature of the nozzle 120 of the print head 118 to constantly maintain the viscosity of the ink, which is sensitive to temperature. The temperature sensor 124 also senses the ambient temperature of the environment in which the printing apparatus operates. The paper releasing unit includes an exit roller 126 that releases the paper P on which an image or text has been printed by the printing unit, and an exit wheel 128.

The printing apparatus according to the embodiment of the present invention further includes a driving controller 100 that controls the driving of the feed roller 114, the exit roller 126, and the pickup roller 112, according to the ambient temperature sensed by the temperature sensor 124.

A method of controlling the driving of the feed roller 114 according to the ambient temperature using the driving controller 100 is described below.

Figure 3:
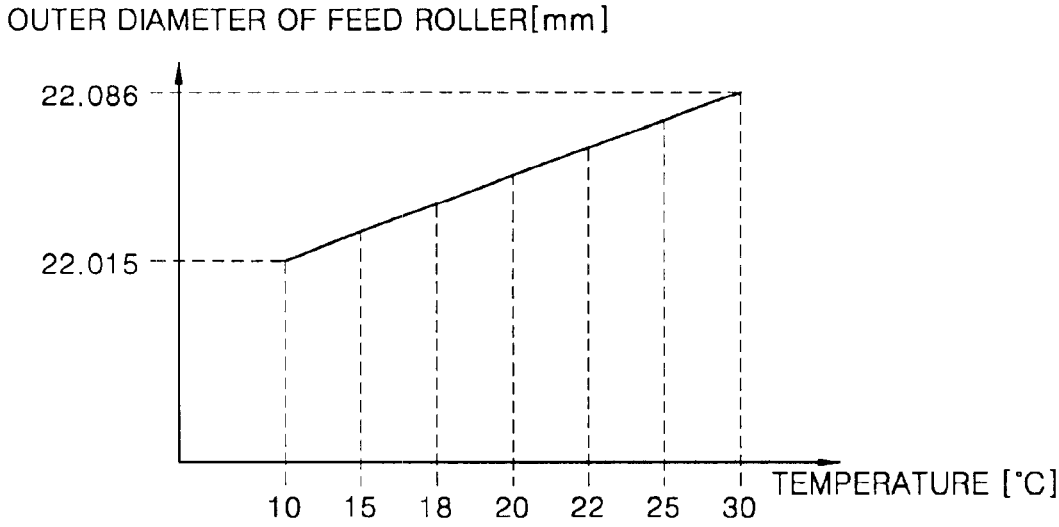
FIG. 3 is a graph illustrating a variation in the outer diameter of a feed roller according to a change in the ambient temperature of the printing apparatus.

FIG. 3 and Table 1 show variations in the outer diameter of the feed roller 114 according to a change in the ambient temperature when the feed roller 114 is formed of EPDM (ethylene propylene diene methylene), which is a kind of synthetic rubber.

TABLE 1

| Temperature (° C.) | Outer Diameter of Feed Roller (mm) |
|---|---|
| 10 | 22.015 |
| 15 | 22.032 |
| 18 | 22.043 |
| 20 | 22.051 |
| 22 | 22.058 |
| 25 | 22.070 |
| 30 | 22.086 |

Referring to FIG. 3 and Table 1, the outer diameter of the feed roller 114 is proportional to the temperature, and a variation in the outer diameter of the feed roller 114 according to the temperature is about 0.0036 mm/° C. Therefore, a variation in the line feed length per one rotation of the feed roller 114 according to the temperature is about 0.0113 mm/° C. per revolution (rev). Assuming that the ambient temperature of the printing apparatus changes within a range from 5° C. to 40° C., the maximum variation in the line feed length per one rotation of the feed roller 114 is 0.3955 mm/rev.

If the outer diameter of the feed roller 114 is 22 mm and the line feed length by the feed roller 114 is set to 0.5 inch, the maximum variation in the line feed length by the feed roller 114 is about 73 $\mu$m within a range from 5° C. to 40° C. The line feed length of 73 $\mu$m is larger than the distance between adjacent dots of 21 $\mu$m, which corresponds to a resolution of 1200 dpi. For this reason, the line feed length must be adjusted according to a change in the ambient temperature to obtain a good quality image.

Figure 4:
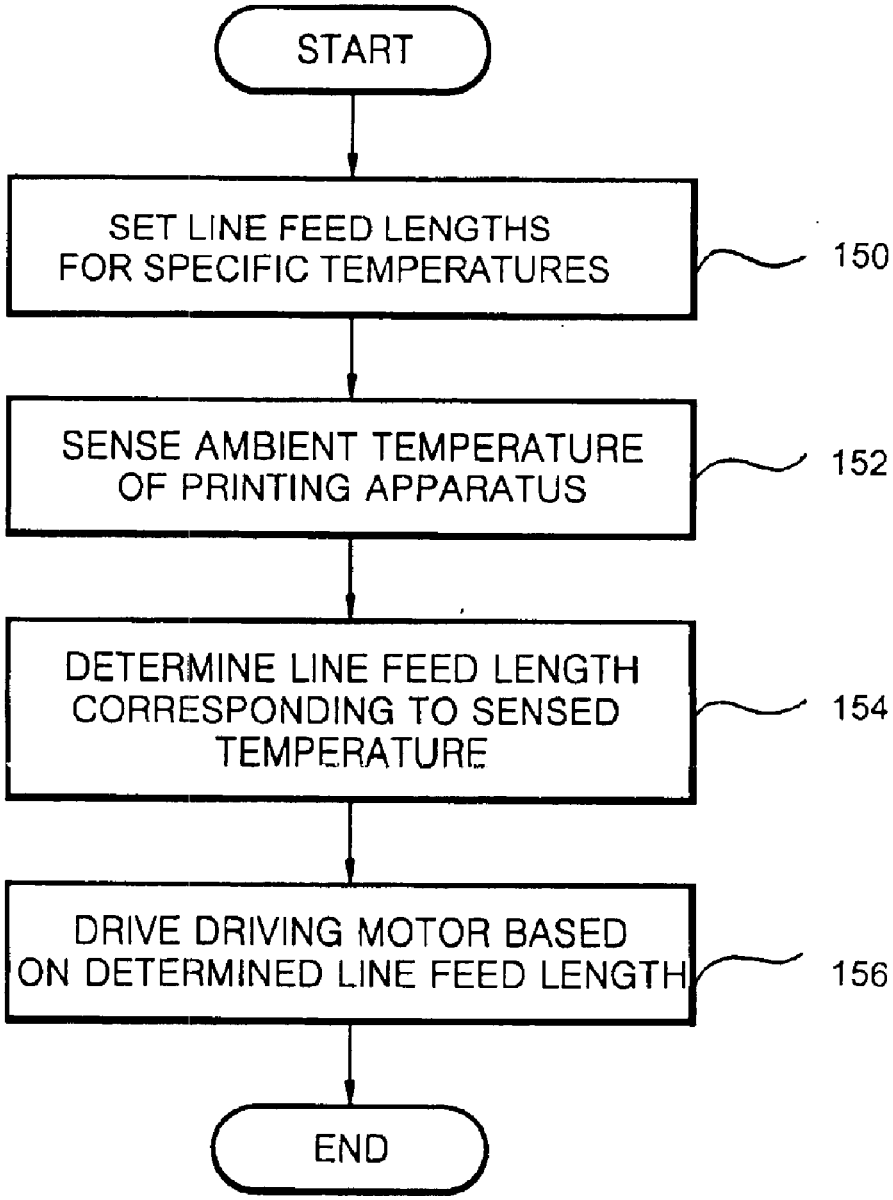
FIG. 4 is a flowchart illustrating a method of controlling driving of a feed roller and an exit roller according to the ambient temperature of the printing apparatus of FIG. 2.

FIG. 4 is a flowchart illustrating methods of controlling the driving of the feed roller 114 and the exit roller 126 according to the ambient temperature surrounding a printing apparatus, using a driving controller 100.

First, a method of controlling the driving of the feed roller 114 of FIG. 2 is described. Referring to FIG. 4, the line feed lengths by the feed roller 114 for specified ambient temperatures are set in the driving controller 100 at operation 150. Next, the temperature sensor 124 installed in the carriage 122 senses the ambient temperature at operation 152, and then the driving controller 100 determines the line feed length based on the sensed temperature at operation 154. A driving motor M connected to the feed roller 114 is driven by the determined line feed length at operation 156.

As mentioned above, the driving controller 100 compensates for a variation in the line feed length by the feed roller 114 according to a change in the ambient temperature of an area in which the printing apparatus operates, thereby improving the quality of printing.

During a printing operation, the paper P passing through the feed roller 114 reaches the exit roller 126, and the driving controller 100 controls the driving of the exit roller 126 and the feed roller 114 according to the ambient temperature.

A method of controlling the driving of the exit roller 126 using the driving controller 100 is similar to that of controlling the driving of the feed roller 114. Therefore, the method of controlling the driving of the exit roller 126 is also described with reference to the flowchart of FIG. 4.

First, at operation 150, the driving controller 100 presets conditions of driving the exit roller 126 according to the ambient temperature, so that line feed lengths by the exit roller 126 for specific temperatures sensed by the temperature sensor 124 can be predetermined.

Next, the temperature sensor 124 senses the ambient temperature around the printing apparatus at operation 152.

Then the driving controller 100 determines line feed length by the exit roller 126 according to the temperature sensed by the temperature sensor 124 at operation 154. Then, the driving motor M connected to the exit roller 126 is driven by the determined line feed length of the exit roller 126 at operation 156.

In general, the feed roller 114 and the exit roller 126 are manufactured using different materials and the dimensions of their outer diameters differ from one another. Thus, a change in the ambient temperature results in a change in the ratio of the linear velocity of the outer surface of the feed roller 114 to that of the outer surface of the exit roller 126. Controlling the driving of the feed roller 114 and the exit roller 126 to solve this problem is described below.

When the paper P is placed both on the feed roller 114 and the exit roller 126, the driving controller 100 controls the driving motor M to adjust the rotation speeds of the feed roller 114 and the exit roller 126 according to the ambient temperature, thereby constantly maintaining the ratio of the linear velocity. Thus, the distance between the paper P and the nozzle 120 of the print head 118 is constantly adjusted. In general, the linear velocity of the exit roller 126 is set to be slightly faster than that of the feed roller 114. The line feed velocity of the paper P is determined by the linear velocity of the feed roller 114.

If the paper P passes through the feed roller 114 and lies only on the exit roller 126 during the printing operation, the driving of the exit roller 126 is controlled such that the linear velocity of the exit roller 126 is equal to that of the feed roller 114 to prevent an unexpected white or black line from appearing on the paper P.

The driving controller 100 controls the driving of the pickup roller 112 according to the ambient temperature of the printing apparatus, thereby compensating for a change in the physical properties of the paper P stacked on the paper tray 110.

The amount of moisture contained in the paper P decreases at a low temperature and a reduction in the amount of moisture increases the stiffness of the paper P. Thus, at low temperatures, a force that the pickup roller 112 applies to the paper P to pick up the paper P from the paper tray 110 must be increased.

The output torque can be increased by varying the rotation speed of the driving motor M or increasing the magnitude of voltage or an electric current applied to the motor M. If the driving controller 100 adjusts the output torque of the driving motor M that drives the pickup roller 112, it is possible to compensate for a change in the physical properties of the paper P stacked on the paper tray 110.

Figure 5:
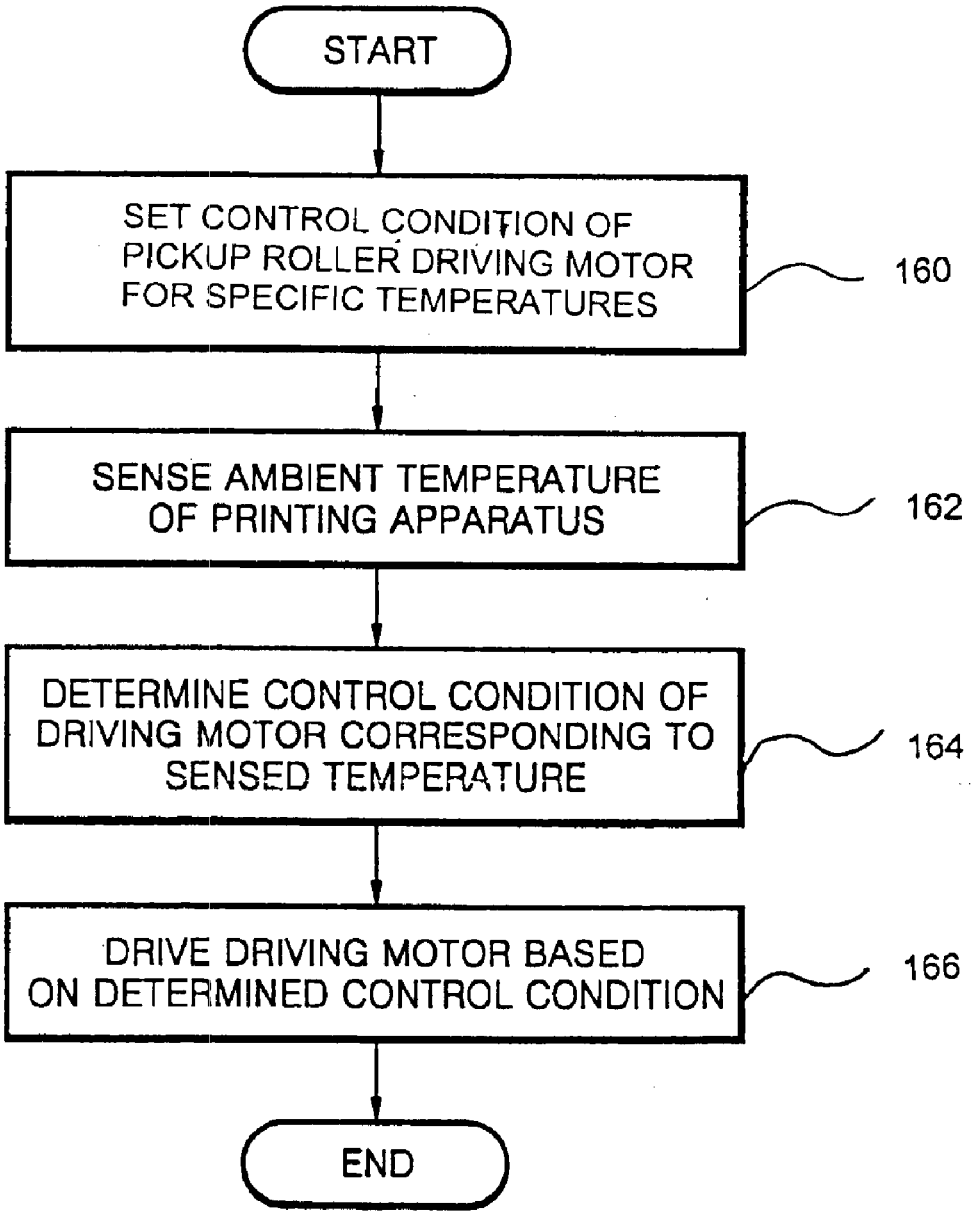
FIG. 5 is a flowchart illustrating a method of controlling driving of a pickup roller according to the ambient temperature of the printing apparatus of FIG. 2.

FIG. 5 is a flowchart illustrating a method of controlling the driving of the pickup roller 112 of FIG. 2 using the driving controller 100 according to the ambient temperature around a printing apparatus.

Referring to FIG. 5, at operation 160, the driving controller 100 presets control conditions of driving the pickup roller 112 according to the ambient temperature so that the rotation speed and output torque of the driving motor M, which drives the pickup roller 112, for specific temperatures are predetermined.

Next, the temperature sensor 124 senses the ambient temperature around the printing apparatus at operation 162.

Next, the driving controller 100 determines control conditions of controlling the driving motor M according to the temperature sensed by the temperature sensor 124 at operation 164. Then, the driving motor M connected to the pickup roller 112 is driven based on the determined control conditions at operation 166.

In this way, the driving controller 100 reduces the rotation speed of the driving motor M that drives the pickup roller 112, thereby increasing the output torque even if the ambient temperature around the printing apparatus is lower than a predetermined temperature.

Accordingly, the driving controller 100 is capable of controlling the driving of the pickup roller 112 according to ambient temperature, thus enabling the paper P to be easily picked up from the paper tray 110.

As described above, a printing apparatus according to the embodiment of the present invention has the following advantages: (i) it is possible to prevent an unexpected white or black line from being printed on paper by controlling the driving of a feed roller according to the ambient temperature of the printing apparatus; (ii) the driving of an exit roller can be controlled according to the ambient temperature to constantly maintain the distance between the paper and a print head, and the appearance of an unexpected white or black line can be prevented when transferring the paper using only the exit roller; and (iii) the driving of a pickup roller can be controlled according to the ambient temperature, and, thus, the paper can be easily picked up from a paper tray at low temperatures.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A printing apparatus having a paper feeding unit with a feed roller that moves paper supplied from a paper tray to a printing unit, and an exit roller that releases the paper on which the printing operation is performed by the printing unit, the printing apparatus comprising:

a temperature sensor sensing an ambient temperature of the printing apparatus; and a driving controller controlling the driving of the feed roller and the exit roller according to the ambient temperature sensed by the temperature sensor.

2. The printing apparatus of claim 1, wherein the driving controller compensates for variations in line feed lengths of the feed roller and the exit roller according to the ambient temperature.

3. The printing apparatus of claim 1, further comprising a pickup roller picking up paper stacked on the paper tray and supplying the paper to the feed roller, wherein the driving controller controls the driving of the pickup roller according to the ambient temperature sensed by the temperature sensor.

4. The printing apparatus of claim 2, further comprising a pickup roller picking up paper stacked on the paper tray and supplying the paper to the feed roller, wherein the driving controller controls the driving of the pickup roller according to the ambient temperature sensed by the temperature sensor.

5. The printing apparatus of claim 3, further comprising a driving motor driving the pickup roller, wherein the driving controller adjusts a rotation speed and an output torque of the driving motor, which drives the pickup roller, according to the ambient temperature sensed by the temperature sensor to compensate for a change in physical properties of the paper stacked on the paper tray due to a change in the ambient temperature.

6. The printing apparatus of claim 4, further comprising a driving motor driving the pickup roller, wherein the driving controller adjusts a rotation speed and an output torque of the driving motor, which drives the pickup roller, according to the ambient temperature sensed by the temperature sensor to compensate for a change in physical properties of the paper stacked on the paper tray due to a change in the ambient temperature.

7. The printing apparatus of claim 5, further comprising a nozzle discharging ink onto the paper, the driving controller controlling the driving motor to adjust a rotation speed of the feed roller and a rotation speed of the exit roller according to the ambient temperature to maintain a ratio of a linear velocity of an outer surface of the feed roller to that of an outer surface of the exit roller, thereby adjusting a distance between the paper and the nozzle.

8. The printing apparatus of claim 7, wherein, if the paper passes through the feed roller and lies only on the exit roller, the driving controller controls the exit roller with the linear velocity of the exit roller equaling the linear velocity of the feed roller.

9. The printing apparatus of claim 1, further comprising:

a driving motor driving the feed roller and the exit roller; and a nozzle discharging ink onto the paper, the driving controller controlling the driving motor to adjust a rotation speed of the feed roller and a rotation speed of the exit roller according to the ambient temperature to maintain a ratio of a linear velocity of an outer surface of the feed roller to that of an outer surface of the exit roller, thereby adjusting a distance between the paper and the nozzle.

10. A method of controlling a feed roller and an exit roller of a printing apparatus according to an ambient temperature of the printing apparatus, the printing apparatus having a driving motor connected to the feed roller and the exit roller, the method comprising:

determining line feed lengths of the feed roller corresponding respectively to ambient temperatures in a predetermined range of ambient temperatures;

sensing an actual ambient temperature of the printing apparatus;

determining a line feed length of the feed roller corresponding to the sensed ambient temperature, and determining a line feed length of the exit roller corresponding to the sensed ambient temperature; and driving, by the driving motor, the feed roller according to the determined line feed length of the feed roller and driving the exit roller according to the determined line feed length of the exit roller, to compensate for a variation in the line feed length of the feed roller and for a variation in the line feed length of the exit roller due to a change in the ambient temperature of the printing apparatus.

11. A method of controlling a pickup roller of a printing apparatus according to an ambient temperature of the printing apparatus, the printing apparatus having a paper tray and a driving motor connected to the pickup roller to pick up paper from the paper tray, the method comprising:

determining rotation speeds and torques of the driving motor corresponding respectively to ambient temperatures in a predetermined range of ambient temperatures;

sensing an actual ambient temperature of the printing apparatus;

determining a rotation speed and a torque of the driving motor corresponding to the sensed ambient temperature; and driving the driving motor connected to the pickup roller according to the determined rotation speed and torque.

12. The method of claim 11, wherein said driving the driving motor comprises reducing the rotation speed of the driving motor, thereby increasing the torque of the driving motor, when the ambient temperature of the printing apparatus is less than a predetermined temperature.

13. A printing apparatus having a paper tray, comprising:

a pickup roller to pick up paper stacked on the paper tray;

a feed roller to move the paper through the printing apparatus;

an exit roller to release the paper from the printing apparatus;

a temperature sensor sensing an ambient temperature of the printing apparatus; and a driving controller controlling the driving of the pickup roller, the feed roller, and the exit roller according to the ambient temperature sensed by the temperature sensor.

14. A printing apparatus having a paper tray, comprising:

a pickup roller to pick up paper stacked on the paper tray;

an exit rover to release paper from the printing apparatus;

a temperature sensor sensing an ambient temperature of the printing apparatus; and a driving controller controlling the driving of the pickup roller and the exit roller according to the ambient temperature sensed by the temperature sensor.

15. A printing apparatus having a paper tray, comprising:

a pickup roller to pick up paper stacked on the paper tray;

a feed roller to move the paper through the printing apparatus;

a temperature sensor sensing an ambient temperature of the printing apparatus; end a driving controller controlling the driving of the pickup roller and the feed roller according to the ambient temperature sensed by the temperature sensor.

* * * * *

UNITED STATES PATENT AND TRADEMARK OFFICE

CERTIFICATE OF CORRECTION

PATENT NO. : 6,872,018 B2
DATED : March 29, 2005
INVENTOR(S) : Jong-Sung Jung

It is certified that error appears in the above-identified patent and that said Letters Patent is hereby corrected as shown below:

Column 9,
Line 12, change “rover” to -- roller --.

Column 10,
Line 9, change “end” to -- and --.

Signed and Sealed this

Twenty-fourth Day of January, 2006

JON W. DUDAS
*Director of the United States Patent and Trademark Office*